US008642860B2

(12) United States Patent
Besnainou et al.

(10) Patent No.: US 8,642,860 B2
(45) Date of Patent: Feb. 4, 2014

(54) STRING MUSIC INSTRUMENT AND SOUND BOARD

(75) Inventors: Charles Besnainou, L'hay les Roses (FR); Adrien Mamou-Mani, Paris (FR); Joël Frelat, Paris (FR)

(73) Assignees: Universite Pierre et Marie Curie (Paris 6), Paris (FR); Centre National de la Recherche Scientifique, Paris (FR)

( * ) Notice: Subject to any disclaimer, the term of this patent is extended or adjusted under 35 U.S.C. 154(b) by 13 days.

(21) Appl. No.: 13/522,664

(22) PCT Filed: Jan. 14, 2011

(86) PCT No.: PCT/EP2011/000137

§ 371 (c)(1),
(2), (4) Date: Jul. 17, 2012

(87) PCT Pub. No.: WO2011/085992

PCT Pub. Date: Jul. 21, 2011

(65) Prior Publication Data

US 2012/0285315 A1 Nov. 15, 2012

(30) Foreign Application Priority Data

Jan. 18, 2010 (FR) ..... 10 50300

(51) Int. Cl.
*G10D 3/02* (2006.01)

(52) U.S. Cl.
USPC ..... 84/294; 84/291; 84/267; 84/274

(58) Field of Classification Search
USPC ..... 84/267, 291, 274, 294
See application file for complete search history.

(56) References Cited

U.S. PATENT DOCUMENTS

| | | | | | |
|---|---|---|---|---|---|
| 483,897 | A * | 10/1892 | Burgner | ..... | 84/294 |
| 1,010,240 | A * | 11/1911 | Degulio | ..... | 84/294 |
| 1,382,310 | A * | 6/1921 | Neilly | ..... | 84/274 |
| 3,656,395 | A | 4/1972 | Kaman | | |
| 5,333,527 | A | 8/1994 | Janes et al. | | |
| 6,563,033 | B1 | 5/2003 | Porzilli | | |
| 7,288,706 | B2 * | 10/2007 | Gaffga | ..... | 84/291 |
| 7,473,831 | B2 * | 1/2009 | Cody | ..... | 84/291 |
| 2012/0285315 | A1 * | 11/2012 | Besnainou et al. | ..... | 84/731 |

FOREIGN PATENT DOCUMENTS

| | | | |
|---|---|---|---|
| DE | 843 050 | C | 7/1952 |
| DE | 200 08 793 | U1 | 9/2001 |
| DE | 10 2007 043796 | A1 | 3/2009 |
| GB | 2 426 118 | A | 11/2006 |

OTHER PUBLICATIONS

Machine tranlation of Description and Claims for Gutsche (DE 843 050) Jul. 8, 1949.*
International Search Report of PCT/EP2011/000137, dated Mar. 16, 2011.

* cited by examiner

*Primary Examiner* — Robert W Horn
(74) *Attorney, Agent, or Firm* — Sughrue Mion, PLLC

(57) ABSTRACT

A musical instrument having strings and a soundboard, wherein the soundboard is excited by the strings by a transducer and is associated with differential stiffening mechanism defining at least two zones of the soundboard that present complementary vibratory behaviors. The two zones are separated by a slot extending along a common boundary between the two zones. The transducer extends across the slot so as to be connected to both zones of the soundboard, such that both zones are excited simultaneously when action is taken on one of the strings.

3 Claims, 3 Drawing Sheets

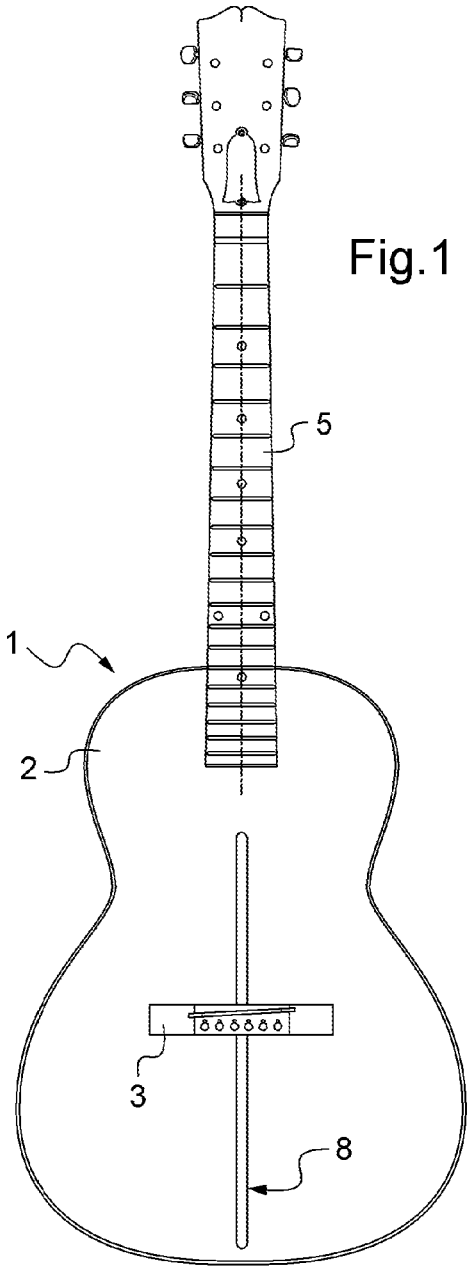
Fig.1
Fig.2
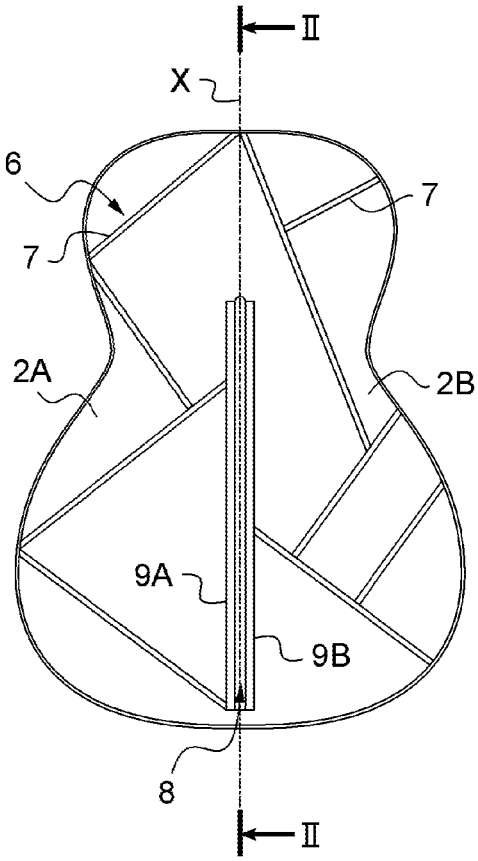

STRING MUSIC INSTRUMENT AND SOUND BOARD

CROSS REFERENCE TO RELATED APPLICATIONS

This application is a National Stage of International Application No. PCT/EP2011/000137 filed Jan. 14, 2011, claiming priority based on French Patent Application No. 10 50300 filed Jan. 18, 2010, the contents of all of which are incorporated herein by reference in their entirety.

TECHNOLOGICAL BACKGROUND OF THE INVENTION

Stringed musical instruments that include a soundboard are known, e.g. a guitar, a violin, or a piano. The soundboard is connected to the strings via a transducer of the bridge type or via any other equivalent device, and it is thus excited when the strings are caused to vibrate. The soundboard then radiates into the surrounding air in order to produce a sound that corresponds to the vibration of the strings.

Various attempts have been made to improve such instruments. In document U.S. Pat. No. 7,288,706, proposals are made to use a plurality of soundboards, each of them being excited by some of the strings. Thus, each soundboard is optimized to amplify the vibrations of the associated strings. Nevertheless, it can happen that the strings are activated in such a manner as to lead to a plurality of soundboards vibrating simultaneously. The soundboards as actuated in this way can emit soundwaves that interfere mutually so as to attenuate the emission of sound in certain frequency ranges. Proposals are also made in document DE 843 050 for the soundboard to be separated into two zones by means of a slot. The two zones may present vibratory behaviors that are distinct if they are associated with differential stiffener means, e.g. such as external boundaries that are not symmetrical or reinforcement that is not symmetrical. Nevertheless, the transducer of the guitar is in two independent portions, each portion being associated with only one of the zones, such that acting on one string causes only the corresponding zone of the soundboard to vibrate.

OBJECT OF THE INVENTION

An object of the present invention is to provide a musical instrument having strings and a soundboard and that emits more uniformly over a given frequency range.

BRIEF SUMMARY OF THE INVENTION

To achieve this object, the invention provides a musical instrument having strings and a soundboard, wherein the soundboard is excited by the strings by means of a transducer and is associated with differential stiffening means defining at least two zones of the soundboard that present complementary vibratory behaviors, the two zones being separated by means of a slot extending along a common boundary between the two zones. According to the invention, the transducer extends across the slot so as to be connected to both zones of the soundboard, such that both zones are excited simultaneously when action is taken on one of the strings.

Thus, the soundboard is stiffened so as to present at least two zones, both of which are excited simultaneously, and that present vibratory behavior that is complementary. For a given excitation, that one of the zones that presents a response low, and that can therefore emit no more than a weakened or smothered sound, is assisted by the other zone, which on the contrary presents a response high, such that the other zone emits a sound that compensates for the weakness of the sound emitted by the first zone.

Unlike a prior art guitar such as that shown in document DE 843 050, the various zones of the soundboard are excited simultaneously. It is thus possible to take full advantage of the complementary vibratory behaviors of the two zones. In document DE 843 050, exciting one zone of the soundboard via one half of the transducer can lead indirectly to the second zone also being excited, but the sound that is then emitted by the second zone is very attenuated compared with the sound emitted by the first zone.

In the invention, the sound of the musical instrument is perceived as being fuller over a wider frequency range.

By way of illustration, simulations have been performed to compare the acoustic qualities of a prior art guitar and of a guitar of the invention. FIG. 4 shows a simulation of the overall impedance as a function of frequency for a guitar of the invention (curve A) and for a conventional guitar (curve B), i.e. a guitar that does not have a slot in the soundboard. It can clearly be seen in this figure that, with the guitar of the invention, the radiation is more uniform for the frequency range in question than it is with the conventional guitar.

It is appropriate to cause the frequency response highs of one of the zones to coincide as closely as possible with the frequency response lows of the other zone, and vice versa.

Figure 3:
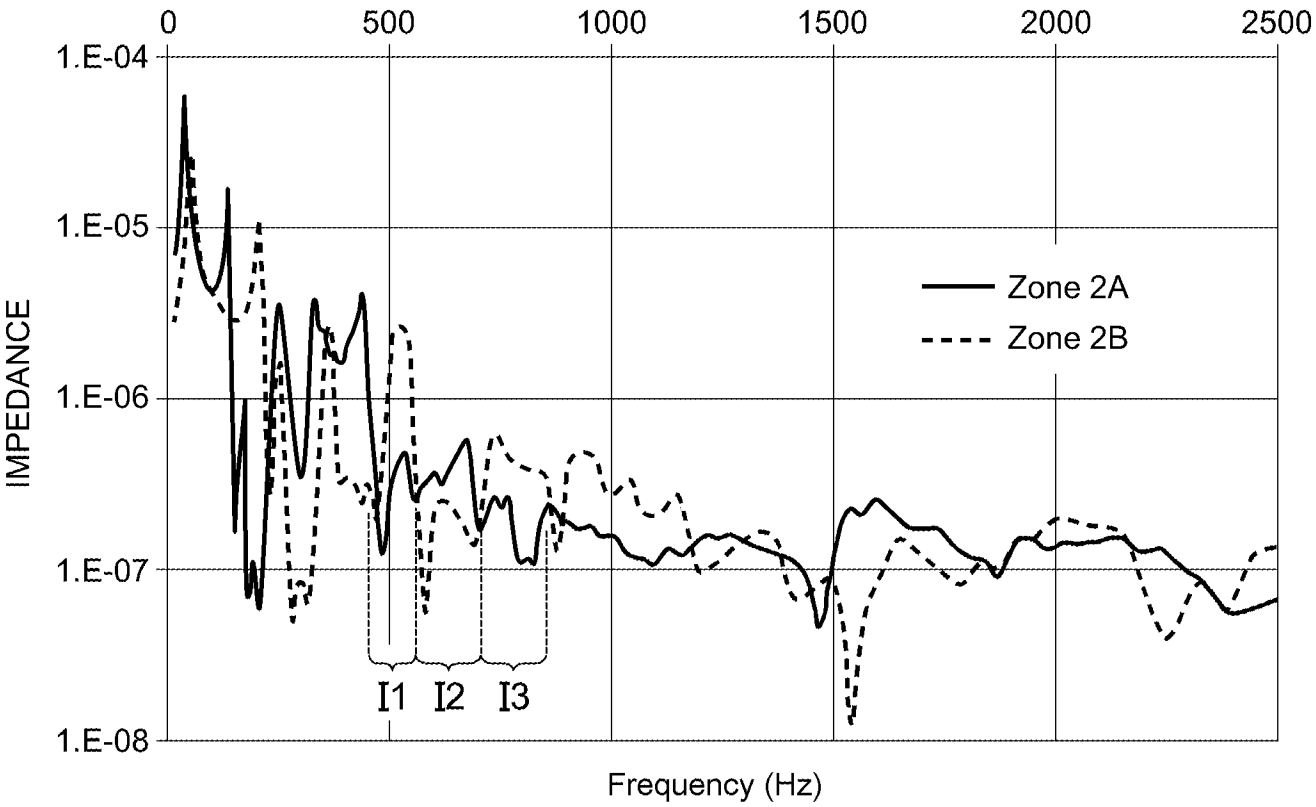
Figure 4:
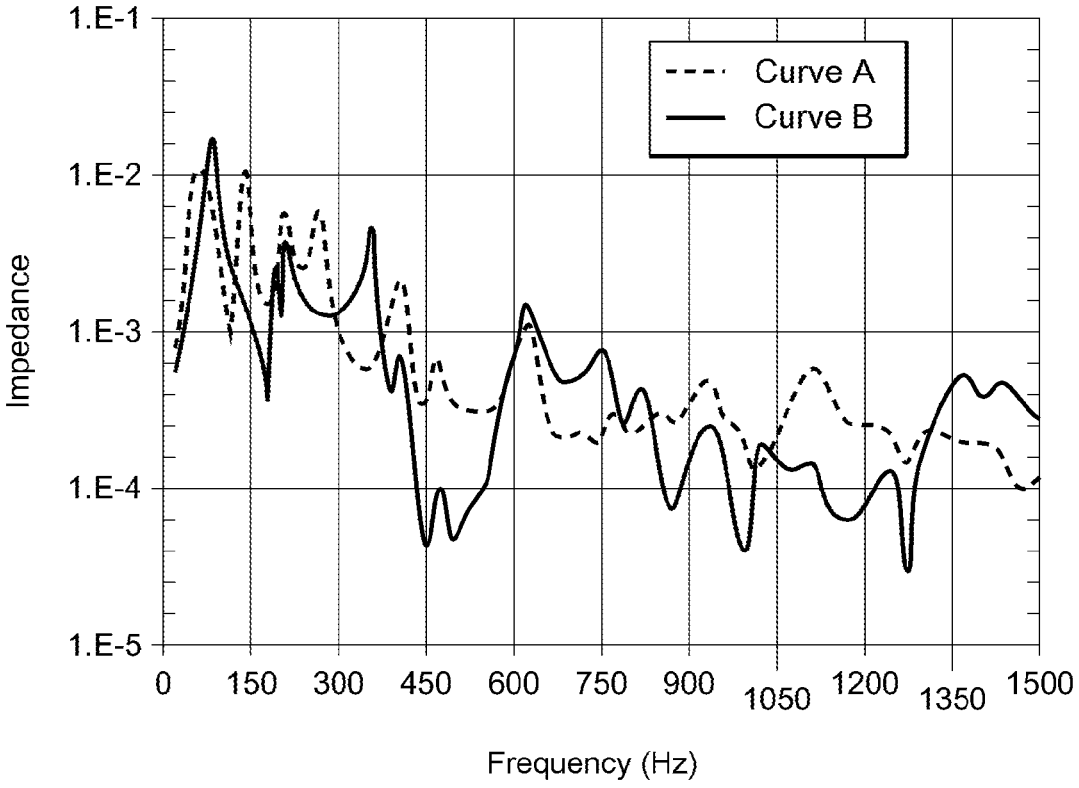
FIG. 4, mentioned above, shows a simulation of the impedance of two guitars as a function of frequency.

The invention can be better understood in the light of the following description of a nonlimiting embodiment of the invention, given with reference to the following figures:

FIG. 1 is a diagrammatic face view of a guitar of the invention;

FIG. 2 is a view of the inside face of the soundboard, showing its obstruction; and FIG. 3 is a graph showing the impedance of each of the zones of the soundboard of the FIG. 1 guitar as a function of frequency.

DETAILED DESCRIPTION OF AN EMBODIMENT OF THE INVENTION

The invention is shown herein in its application to a guitar. Naturally, the invention is applicable to any stringed instrument using a transducer to excite a soundboard, such as a violin or a piano.

In known manner, the guitar shown in FIG. 1 comprises a body 1 closed in its front portion by a soundboard 2 on which a bridge 3 is fitted. Strings are tensioned between the bridge 3 and the end of a neck 5 that is secured to the body 1. For greater clarity, the strings are not shown in the drawing. Action on one or more of the strings causes them to vibrate, with the vibration being transmitted via the bridge 3 to the soundboard 2, which then begins to vibrate and thus to radiate into the surrounding air.

As can be seen in FIG. 2, the soundboard 2 is stiffened by an obstruction 6 made up of strips 7 (only some of them are referenced) that are stuck to the inside face of the soundboard. According to the invention, the obstruction 6 is designed to define two zones 2A and 2B on the soundboard that present vibratory behaviors that are distinct, but complementary, as explained below. In practice, in this example, each of the two zones 2A and 2B extends between the peripheral edge of the soundboard 2 and a central axis of symmetry X. It can be seen immediately that the obstruction 6 has an asymmetrical configuration, imparting a specific vibratory behavior to each of the two zones 2A and 2B.

A slot 8 is formed through the soundboard 2 along the boundary between the two zones 2A and 2B, specifically along the axis of symmetry X. In this example, the slot extends from the sound hole to the proximity of the edge of the soundboard. Each of the zones 2A, 2B presents a free edge that is stiffened by a respective stiffener 9A, 9B fitted thereto.

It should be observed that both zones are excited simultaneously when action is taken on the strings, since the bridge 3 extends across both zones 2A, 2B in order to transmit the vibration of the strings thereto. The zones 2A and 2B thus radiate simultaneously.

It should also be observed that the soundboard no longer has a sound hole or a rosace, since the slot 8 replaces it.

According to the invention, the zones 2A and 2B have complementary vibratory behaviors such that, at least in a given frequency range, a frequency response low in one of the zones corresponds to a frequency response high in the other. This can be seen in the graph of FIG. 3, which shows the principle of frequency matching between the two zones. Lows in one of the two curves correspond to highs in the other, e.g. in the ranges I1, I2, or I3, or in alternative manner, the impedance response of one of the zones compensates that of the other zone.

This arrangement leads to more uniform radiation over the entire frequency range in question, and gives the instrument a sound that is fuller and more uniform. By way of example, the vibratory behaviors of the two zones may be adjusted so that one of them responds better to low frequencies and the other responds better to high frequencies.

It should be understood that this behavior is significantly different from the simple vibration of a soundboard in modes that are anti-symmetrical at certain frequencies. Under such circumstances, portions of the soundboard are caused to beat in phase opposition. In those modes, only the modes that present odd symmetry radiate a far-field soundwave. Nevertheless, the same portions beat in-phase for vibrations having even symmetry, and then no far-field sound is radiated. In contrast, in the invention, attempts are made to design the two zones in such a manner that if one of them vibrates little or not at all at certain frequencies, then the other takes over and vibrates so as to compensate for the lack of sound production by the first zone. Naturally, steps are taken to avoid both zones vibrating in phase opposition for a given frequency.

The soundboard 2 and the obstruction 6 are preferably arranged to establish a set of static stresses in the soundboard, once the strings have been tensioned, that is close to a critical state for buckling, such that the soundboard is in an equilibrium configuration at the buckling limit. This configuration enhances the appearance of non-linear vibrations of the soundboard, thereby enriching the sound spectrum and producing a more vibrant dynamic.

The invention is not limited to the above description, but on the contrary covers any variant coming within the ambit defined by the claims.

In particular, although the two above zones 2A and 2B are of shapes that are superposable, but that are made asymmetrical from the point of view of their frequency responses by using an asymmetrical obstruction, any other arrangement could be used to define the two zones having different frequency behaviors in the soundboard. For example, action could be taken on the shapes of the zones in order to make one more rigid than the other, obstructions could be provided that are adapted to optimizing their frequency responses, and it is also possible to act on the thickness of the board in each of the zones, i.e., in practice, to use differential stiffening means to adjust the vibratory behaviors of the two zones.

Finally, although it is stated that the soundboard is divided into two zones, it would naturally be possible to divide the soundboard into more than two zones having complementary vibratory behaviors.

The invention claimed is:

1. A musical instrument having strings and a soundboard, wherein the soundboard is excited by the strings by a transducer and is associated with differential stiffening means defining at least two zones of the soundboard that present complementary vibratory behaviors, the two zones being separated by a slot extending along a common boundary between the two zones, wherein the transducer extends across the slot so as to be connected to both zones of the soundboard, such that both zones are excited simultaneously when action is taken on one of the strings.

2. A musical instrument according to claim 1, wherein the soundboard does not have any sound hole other than the slot.

3. A musical instrument according to claim 1, wherein the soundboard and the stiffening means are arranged in such a manner that after the strings have been tensioned, the soundboard is subjected to a static stress state that is close to a critical buckling state.

* * * * *